United States Patent [19]

Bacon

[11] 4,125,437

[45] Nov. 14, 1978

[54] DISTILLATION SYSTEM

[76] Inventor: Conrad G. Bacon, 2960 Hannah Ave., Norristown, Pa. 19403

[21] Appl. No.: 737,773

[22] Filed: Nov. 1, 1976

[51] Int. Cl.[2] ..... C10B 1/10

[52] U.S. Cl. ..... 202/117; 198/658; 201/44; 202/131; 432/107; 432/110

[58] Field of Search ..... 202/118, 131, 117, 128, 202/216, 218; 201/32, 44; 432/107, 110; 34/135, 136, 137; 198/658

[56] References Cited

U.S. PATENT DOCUMENTS

| | | | |
|---|---|---|---|
| 1,237,094 | 8/1917 | Prioleau | 202/118 |
| 1,548,307 | 8/1925 | Giger | 202/118 X |
| 1,551,197 | 8/1925 | Krebs | 432/107 X |
| 2,435,825 | 2/1948 | Goss | 202/117 X |
| 2,469,562 | 5/1949 | Kennedy | 432/107 X |
| 2,697,068 | 12/1954 | Poindexter et al. | 202/118 X |
| 2,973,306 | 2/1961 | Chick et al. | 202/118 X |
| 3,691,019 | 9/1972 | Brimhall | 202/118 |

FOREIGN PATENT DOCUMENTS

| | | | |
|---|---|---|---|
| 2,456,158 | 6/1975 | Fed. Rep. of Germany | 198/658 |

*Primary Examiner*—Morris O. Wolk
*Assistant Examiner*—Arnold Turk
*Attorney, Agent, or Firm*—Morton J. Rosenberg

[57] ABSTRACT

Distillation system for distilling shale oil. Shale is inserted into a rotating retort which displaces the shale throughut the retort extended length. The rotating retort is mounted to a multiplicity of enclosed housings through rotative bearings. The enclosed housings form discrete heating chambers to provide individual temperature zones through which the shale passes in the distilling process. The multiplicity of housings are each connected to a next consecutive housing through a conduit which permits utilization of combustion gases from a common source to heat each of the temperature zones. A thermal control mechanism is coupled to each of the enclosures to provide temperature control within a particular temperature zone. Thus, the shale in its passage through the retort is subjected or exposed to predetermined temperature ranges within each of the enclosures for a predetermined time in order to maximize the efficiency of the shale oil recovery process.

7 Claims, 3 Drawing Figures

DISTILLATION SYSTEM

BACKGROUND OF THE INVENTION

1. Field of the Invention

This invention pertains to oil distillation systems. In particular, this invention relates to a distillation system utilizing a high efficiency shale oil recovery retort. More in particular, this invention pertains to a rotating retort which is enclosed within discrete enclosures defining particular temperature zones. Still further, this invention relates to an improved distillation system where the temperature of each of a series of temperature zones is maintained at a subsantially constant temperature to respectively remove light, intermediate and heavy distillates.

2. Prior Art

Shale oil distillation systems are known in the art. However, in some such prior systems, the shale is exposed to one temperature zone. In general, such prior systems utilize a high temperature zone for removal of the various distillates. However, where high temperature zones are utilized it has been found that the low temperature boilers are destroyed by thermal cracking. Thus, valuable distillates are lost in such prior systems.

In other prior systems, individual heating chambers have been used in various stages of the distillation process. In such systems, extreme amounts of fuel had to be utilized in order to maintain various zones at predetermined temperatures. This had the effect of increasing the cost of shale oil recovery and did not allow for economic feasibility.

Additionally, in systems utilizing discrete temperature zones for the distillation process, the zones were not thermally controlled as a function of combustion gases being emitted from a common source. Thus, in some such prior systems, the temperature control was not accurate and thus there was the possibility of providing over distillation temperatures which in some cases had the results of destroying certain distillates.

SUMMARY OF THE INVENTION

A distillation system which includes a retort mechanism for displacing material to be distilled through a plurality of heating zones. The system includes a plurality of discrete enclosures surrounding the retort mechanism with each of the enclosures forming a heating chamber defining the heat zones to be maintained at predetermined temperatures. A combustion chamber is coupled to at least one of the enclosures to provide a heating mechanism for each of the heating zones. The system further includes a thermal control mechanism for maintaining a predetermined temperature in each of the enclosures with each of the enclosures being thermally coupled to a next consecutively positioned enclosure.

DESCRIPTION OF THE PREFERRED EMBODIMENTS

Figure 2:
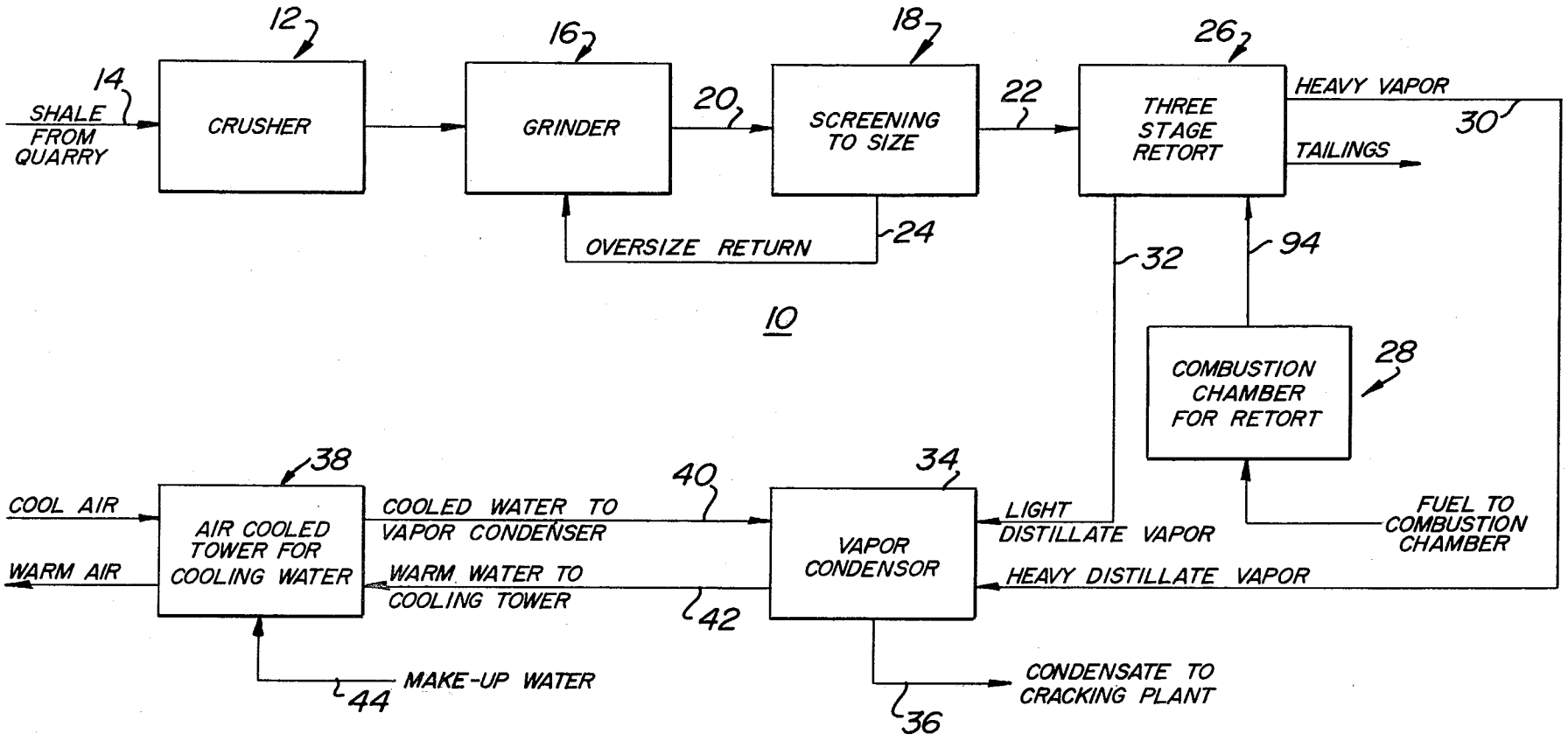
FIG. 2 is a schematic block flow diagram of the improved distillation system.

Referring now to FIG. 2 there is shown improved distillation system 10 for distilling material being displaced therethrough. In particular, improved distillation system 10 is directed to a high efficiency shale oil recovery system for recovering light, medium, and heavy oil distillates from initially introduced shale material. As will be seen in following paragraphs, the overall concept of improved distillation system 10 is to provide for distillation in three distinct and separate temperature zones in an improved manner which has been found to increase the distillation efficiency over an average single temperature zone retort by approximately 15%. Single high temperature retorts have in the past yeilded a recovery efficiency of approximately between 60–70% whereas the improved distillation system 10 of the instant invention has been calculated to provide a recovery efficiency of between 80–85%.

In the three temperature zone distillation system 10 of the instant invention, the shale is distilled initially in a low temperature zone which is maintained at a predetermined temperature range sufficient to distill the low dwelling fraction without thermal cracking occurring. The material being distilled then passes to a next higher temperature zone where the medium distillates are distilled from the material, once again without thermal cracking occurring. Finally, the heavy distillates are distilled in a final high temperature zone to recover any heavy distillates. In systems where single high temperature zones are maintained throughout the distillation process, the light distillates are generally destroyed by internal thermal cracking thus lowering the overall efficiency of the system.

Referring to the overall process shown in FIG. 2, shale in the quarry is mined in generally 4–6 inch sizes. The shale is brought to crusher mechanism 12 by conveyor 14 or other like means not important to the inventive concept. Crusher mechanism 12 may be of a standard rotary or jaw type device which reduces the shale size sufficient to be acceptable to grinder 16. Grinder 16 may be of the ball or rod mill type which is well known in the art. Shale, further reduced in grinder 16 is passed to screening mechanism 18 through conveyor line 20. Screen mechanism 18 may be a standard rotary type of screening mechanism which is utilized for outputting shale on conveyor line 22 which has a size range approximately between 10–20 mesh. It has been found that shale to be utilized in the retort system to be described in following paragraphs has excellent thermal contact within the retort system when the general size of the shale particulates is in the range of 10–20 mesh. Shale within screening mechanism 18 which is found to be oversized is fed back to grinder mechanism 16 on oversized return line 24.

Shale which is reduced to the proper size is inserted into retort system 26 which is heated by combustion chamber 28. Heavy and light distillates egress along conduit lines 30 and 32 respectively. Both of the light and heavy distillate vapors within conduits 32 and 30 are inserted into vapor condensor 34 where they are each in turn condensed back to a liquid and the condensate is directed to a cracking plant along line 36. Vapor condensor 34 is maintained below the condensing temperature point of the two vapor ranges of the light and heavy distillates by circulation of a coolant passing between condensor 34 and tower 38 through appropriate conduit lines 40 and 42. Generally, this recirculation process is through a closed cycle utilizing water or some other heat transfer medium not important to the inventive concept as is herein described. Where water is being used as the cooling medium, additional make-up water may be added to cooling tower 38 through line 40.

Thus, in overall concept, shale is mined from a quarry and initially reduced in size to a predetermined dimensional range. The dimensional range is calculated to provide maximum thermal contact of the shale within the retort system 26 thereby increasing the efficiency of overall system 10. The appropriately reduced in size shale is passed through retort system 26 where heavy and light distillate vapors are removed and inserted into vapor condensor 34. The vapors are condensed and sent to a cracking plant for further refining processes.

Figure 1:
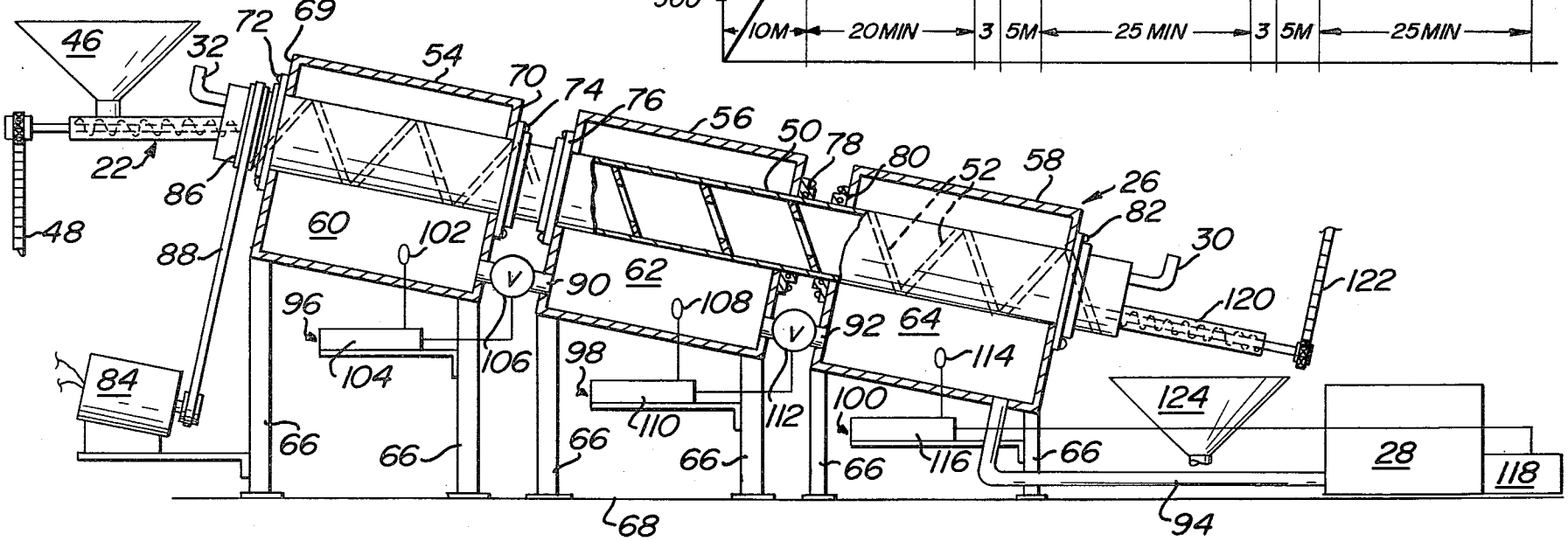
FIG. 1 is a schematic elevational view of the retort system.

Referring now to FIG. 1, there is shown distillation retort system 26 for removal of the heavy and light distillate vapors through conduits 30 and 32 respectively which is derived from the appropriately sized shale input. Shale is inserted within hopper 46 and directed to line 22 which may be a worm feed driven through a chain mechanism 48 or some like device. Shale is directed through worm feed line 22 into cylindrical retort 50 as is shown. Retort 50 displaces the shale to be distilled through a plurality of heat zones as will be described in following paragraphs. Retort 50 is generally cylindrical in geometrical contour and has an extended length in the direction of flow of the shale material. Additionally, cylindrical retort 50 includes a series of helical or spirally formed grooves 52 formed within an inner wall of retort 50 for releasably capturing and displacing the shale material responsive to a rotative displacement of retort 50. In order to more easily facilitate the displacement of the waste material from initial insert to final egress from retort 50, it is seen that retort 50 is positionally declined in a direction of the flow of the material being distilled. Although not critical to the inventive concept as is herein described, it has been found that the declination angle may advantageously be determined between 10°–45° which has been found to provide for a constant flow of material while maintaining the material in the heating zones for a sufficient length of time that they may be distilled with high efficiency. Retort 50 may be formed of steel or some like material having a temperature capability sufficient not to degrade in the high temperature ranges of the distillation process.

Surrounding and completely enclosing an outer wall of retort 50 are discrete enclosures or housings 54, 56 and 58. Each of housings 54, 56, and 58 form respective heating chambers 60, 62, and 64 which define the heating zones through which the shale passes and is distilled into the heavy and light vapors. Each of housings 54, 56, and 58 completely surround and are contiguous to an outer lateral surface of retort 50 and are spaced each from the other to provide enclosed chambers 60, 62 and 64. The enclosures are rigidly secured to vertically directed columns 66 which are bolted or otherwise fastened in secured relation to base surface 68.

Housing or enclosure 54 includes a pair of longitudinally opposed end walls 69 and 70 to which are mounted rotative bearings 72 and 74 within which retort 50 is free to be rotatively displaced. In similar fashion retort 50 is mounted through rotative bearings 76 and 78 formed on end walls of housing 56. Additionally, retort 50 passes through rotative bearings 80 and 82 on opposing end walls of housing 58. Thus, each of housings 54, 56 and 58 are positionally fixed with respect to base surface 68 but permit rotation of retort 50 with respect thereto. Retort 50 is rotatively displaced with respect to enclosures 54, 56, and 58 by actuation of drive mechanism or standard motor means 84 which is connected to retort pulley 86 through endless belt 88 as is shown in FIG. 1. Although not important to the inventive concept as is herein described, drive motor 84 may be a standard 100 horsepower motor adapted to rotatively displace retort 50 at approximately one revolution per minute. Still further, enclosures 54, 56, and 58 may in general be cylindrical in contour, rectangular or other closed shape not important to the inventive concept. Additionally, housings 54, 56 and 58 may be formed of fire wall to provide material having sufficient structural integrity under the extreme temperatures provided within chambers 60, 62 and 64.

Each of enclosures 54, 56 and 58 are thermally coupled to a next consecutively positioned enclosure or housing through conduits 90 and 92. Second housing 56 is coupled to first housing 54 through conduit 90 to allow for flow of combustion gases from second housing 56 to first housing 54. In a similar manner, third housing 58 is coupled to second housing 56 through combustion gas conduit 92. Thus, there is a continuous flow of heated gases passing from third chamber or heat zone 64 to second chamber or heat zone 62 and finally to first chamber or heat zone 60. Third chamber or heat zone 64 is provided with combusion gases passing from combustion chamber 28 through conduit 94. Combustion chamber 28 may be a coal or oil type heating mechanism not important to the inventive concept as is herein developed however, with the exception that furnace or heater 28 provide sufficient heat at its exhaust end to provide for the elevated temperatures necessary in the distillation process.

In order to provide for high efficiency in the distillation process, it has been found that the shale being distilled should be raised to approximately 800° F. within heat chamber 60, approximately 1000° F. within second heat chamber 62 and finally third heating chamber 64 should be maintained within a range approximately between 1200° F.–1300° F. In order to maintain predetermined temperatures within each of enclosures 54, 56 and 58, thermocouple control devices 96, 98 and 100 are mounted adjacent to and partially within each of housings 54, 56 and 58. First thermocouple control mechanism 96 includes thermocouple element 102 within chamber 60. Thermocouple 102 is connected to thermocouple amplifier 104 which in turn is connected or coupled to damper 106 within conduit 90 as is shown in FIG. 1. Damper 106 is of a type well known in the art and merely allows the entrance of external ambient air into conduit 92 to intermix with gases passing from heating zone or chamber 62. Thus, in the thermal control system provided by thermocouple control 96, where thermocouple element 102 senses a high temperature above approximately 800° F., such is transmitted to damper 106 through thermocouple amplifier 104 to open damper 106 thereby allowing ingress of ambient air to bring heating chamber 60 to an appropriate temperature range. Thus, by intermixing combustion gases being emitted from a next consecutively removed heating chamber with ambient air, a particular chamber temperature may be maintained.

In a similar manner, second thermocouple control mechanism 98 operates through thermocouple element 108 in conjunction with thermocouple amplifier 110 and damper 112 to maintain temperatures within combustion chamber or second heating zone 62 at approximately 1000° F.

Third thermocouple control device 100 includes a thermocouple element 114 within chamber 64. Thermocouple element 114 is connected to a similar thermocouple amplifier 116 which is coupled to feed stoker 118 regulating the input to furnace combustion chamber 28. Thus, the exhaust gases on line 94 may be controlled in temperature to maintain a third heat zone chamber 64 in the range of 1200°–1300° F.

Figure 3:
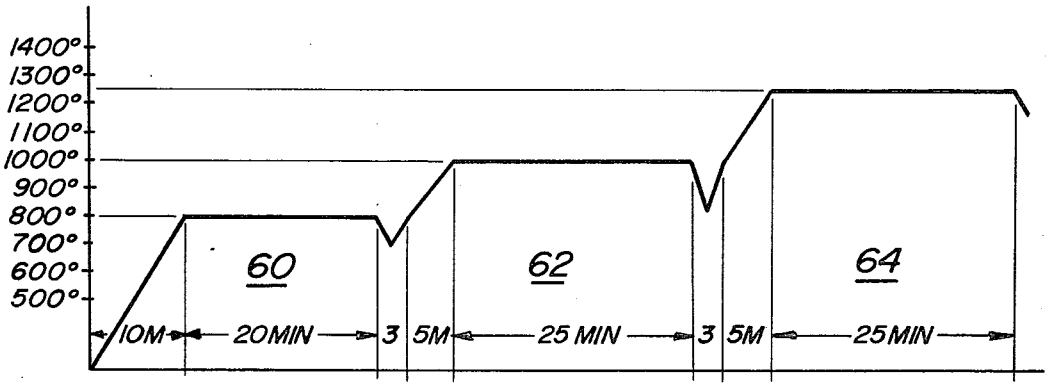
FIG. 3 is a graph showing a temperature-time history for the distillation process as the material being distilled is passed through a plurality of heating zones.

Referring now to FIGS. 1 and 3 and by way of example, utilizing retort 50 having an extended length of approximately 100 feet with a rotational displacement of approximately one revolution per minute the entire time for passage of shale material through distillation retort system 26 is approximately 86 minutes or approximately 1.5 hours. Shale is brought into initial heat zone 60 from ambient temperature considerations through worm drive 22. The shale is brought from ambient temperature to approximately 800° F. in a somewhat although not exactly linear fashion in approximately 10 minutes as is seen in FIG. 3. At the temperature of 800° F., distillation is initiated. Distillation continues within heat zone 60 for approximately 20 minutes where the low molecular weight distillates are distilled from the shale without thermal cracking occurring. Such low weight distillates include benzine, kerosene, and some gasolines. Such low weight distillates have been found to remain in the area of the upper portion of retort 50 within the general locational position defined by first housing 54. Thus, conduit 32 is provided at an end point to allow removal of the light distillates.

The shale being distilled egresses from first heat chamber 60, there is a dropping of temperature due to thermal coupling to the ambient external environment. As the shale comes into the vicinity of second heating chamber 62, the temperature begins to rise in a somewhat although not exact linear fashion until a temperature of approximately 1000° is reached. Maintenance of this temperature is for approximately 25 minutes within intermediate or second heating chamber 62 where intermediate distillates are removed. These intermediate distillates may include heavy kerosenes as well as heavy napthas and other like hydrocarbon compositions.

Finally after egress from second heating chamber 62, the remaining shale material is inserted into chamber 64 where the temperature is raised to 1200°–1300° F. and maintained for approximately 25 minutes. In this chamber heavy distillates and tars are distilled from the remaining material. The intermediate distillates and the heavy distillates are removed from an end section of retort 50 through conduit 30 as is seen in FIG. 1.

Exhaust feed worm mechanism 120 driven through chain element 122 or some like mechanism discharges the now distilled shale into exhaust hopper 124 for removal from system 10.

While the invention has been described with certain specific embodiments thereof, it will now be understood that further modifications will suggest themselves to those skilled in the art and it is intended to cover such modifications within the scope of the appended claims.

What is claimed:

1. A distillation system comprising:

(a) retort means for displacing shale material to be distilled through a plurality of heat zones said retort means including a cylindrical retort having spirally formed grooves within an inner wall of said retort;

(b) means for rotatably displacing said retort means;

(c) a plurality of discrete enclosure means spaced each from the other and surrounding said retort means, each of said enclosure means defining a housing forming a heating chamber defining said heat zones through which said retort means passes;

(d) heating means coupled to one of said enclosure means for producing heated gases to be fluidly displaced consecutively through each of said discrete enclosure means;

(e) means thermally coupling each enclosure means to a next consecutively positioned enclosure means for passing heated gases from one of said enclosure means to a next consecutive enclosure means; and (f) means for maintaining a predetermined temperature in each of said enclosure means including means for the insertion of ambient air into an enclosure means dependent upon said predetermined temperature to be maintained in said enclosure, and including thermocouple control means mounted within each heating chamber for controlling flow of heated gas and said ambient air into said heat chambers for maintenance of said predetermined temperatures.

2. The distillation system as recited in claim 1 where said means for maintaining a predetermined temperature includes damper means respectively mounted within said means for thermally coupling each enclosure, and where each of said damper means is coupled to a respective thermocouple control means within a respective heat chamber for regulating ambient air quantities to be introduced into said combustion gas flow path responsive to a particular thermocouple control means temperature evaluation.

3. The distillation system as recited in claim 1 where said retort means is positionally declined in a direction of flow of said material being distilled.

4. The distillation system as recited in claim 1 where each of said housings include rotative bearing means mounted on opposing end walls and encompassing an outer wall of said retort means for rotative displacement of said retort means with respect to each of said housings.

5. The distillation system as recited in claim 4 where said plurality of housings includes:

(a) a first housing;

(b) a second housing coupled to said first housing for flow of combustion gases from said second housing to said first housing; and, (c) a third housing coupled to said second housing for flow of combustion gases from said third housing to said second housing, said third housing being coupled to said heating means for entrance of said combustion gases from said heating means to said third housing.

6. The distillation system as recited in claim 5 wherein said means for thermally coupling includes conduits.

7. The distillation system as recited in claim 6 where said heating means includes a combustion chamber coupled to said third housing for introduction of combustion gases to said third heat chamber formed within said third housing.

* * * * *